US010480236B2

(12) United States Patent
Söderqvist

(10) Patent No.: US 10,480,236 B2
(45) Date of Patent: Nov. 19, 2019

(54) METHOD OF OPERATING A SWING DOOR, DEVICE FOR OPERATING A SWING DOOR AND A SWING DOOR OPERATED BY SUCH A METHOD AND/OR HAVING SUCH A DEVICE

(71) Applicant: ASSA ABLOY ENTRANCE SYSTEMS AB, Landskrona (SE)

(72) Inventor: Sven-Gunnar Söderqvist, Vallåkra (SE)

(73) Assignee: ASSA ABLOY ENTRANCE SYSTEMS AB, Landskrona (SE)

( * ) Notice: Subject to any disclaimer, the term of this patent is extended or adjusted under 35 U.S.C. 154(b) by 9 days.

(21) Appl. No.: 15/556,554

(22) PCT Filed: Mar. 22, 2016

(86) PCT No.: PCT/EP2016/056239
§ 371 (c)(1),
(2) Date: Sep. 7, 2017

(87) PCT Pub. No.: WO2016/156108
PCT Pub. Date: Oct. 6, 2016

(65) Prior Publication Data

US 2018/0051501 A1 Feb. 22, 2018

(30) Foreign Application Priority Data

Mar. 31, 2015 (SE) ..... 1550379-0

(51) Int. Cl.
*E05F 15/611* (2015.01)

(52) U.S. Cl.
CPC ..... *E05F 15/611* (2015.01); *E05Y 2400/31* (2013.01); *E05Y 2400/354* (2013.01); *E05Y 2400/36* (2013.01)

(58) Field of Classification Search
CPC . E05F 15/63; E05F 15/60; E05F 15/70; E05F 15/224; E05Y 2400/302;
(Continued)

(56) References Cited

U.S. PATENT DOCUMENTS 3,235,247 A 2/1966 Tolson
3,470,653 A 10/1969 Kalog
(Continued)

FOREIGN PATENT DOCUMENTS

WO 2014152907 A1 9/2014
WO WO2014/152907 * 9/2014

OTHER PUBLICATIONS

International Search Report and Written Opinion mailed in International Appln PCT/EP2016/056239 dated Jun. 14, 2016 (8 pages).
(Continued)

*Primary Examiner* — Justin B Rephann
(74) *Attorney, Agent, or Firm* — Wissing Miller LLP

(57) ABSTRACT

The invention relates to a method of operating a swing door, whereby a drive moves a door leaf from a first position of the door leaf to a second position of the door leaf. For providing an operation of the swing door in a more effective and/or efficient way the method is characterized in that the drive adds an additional driving force and/or torque to the door leaf in the first position and/or the second position of the door leaf in relation to an external driving force and/or torque acting on the door leaf to hold the door leaf in the first position or second position, respectively.

14 Claims, 3 Drawing Sheets

(58) Field of Classification Search
CPC ..... E05Y 2400/46; E05Y 2800/113; E05Y 2201/41; E05Y 2201/434
See application file for complete search history.

(56) References Cited

U.S. PATENT DOCUMENTS

| | | | | | |
|---|---|---|---|---|---|
| 4,501,090 | A | | 2/1985 | Yoshida et al. | |
| 4,973,894 | A | * | 11/1990 | Johansson | E05F 1/1016 318/266 |
| 5,687,507 | A | * | 11/1997 | Beran | E05F 15/70 49/339 |
| 2009/0265992 | A1 | * | 10/2009 | Hass | E05F 15/63 49/340 |
| 2010/0115853 | A1 | | 5/2010 | Gebhart et al. | |
| 2010/0242368 | A1 | * | 9/2010 | Yulkowski | E05F 15/50 49/349 |
| 2014/0325911 | A1 | * | 11/2014 | Hass | E05F 15/70 49/31 |
| 2016/0024831 | A1 | * | 1/2016 | Houser | E05F 15/611 49/29 |

OTHER PUBLICATIONS

SE Search Report dated in SE 1550379-0 (11 pages) dated Oct. 13, 2015.

* cited by examiner

METHOD OF OPERATING A SWING DOOR, DEVICE FOR OPERATING A SWING DOOR AND A SWING DOOR OPERATED BY SUCH A METHOD AND/OR HAVING SUCH A DEVICE

This application is a 371 of PCT/EP2016/056239 filed on Mar. 22, 2016, published on Oct. 6, 2016 under publication number WO 2016/156108, which claims priority benefits from Swedish Patent Application No. 1550379-0 filed Mar. 31, 2015, the disclosure of which is incorporated herein by reference.

The invention relates to a method of operating a swing door, whereby a drive moves a door leaf from a first position of the door leaf to a second position of the door leaf. Furthermore, the invention relates to a device for operating a swing door having a drive for moving a door leaf from a first position of the door leaf to a second position of the door leaf. Moreover, the invention is related to a swing door operated by such a method and/or having such a device.

Depended on the surrounding of a door leaf and/or a swing door external forces may act on the door leaf. Such external forces may arise by wind flows and/or a pressure difference on both sides of the door leaf. A pressure difference may arise from a high stack pressure within a building. Thus, the driving force and/or torque of the drive has to be adjusted in a way that the door leaf is moved in a reliable way under consideration of the size and/or weight of the door leaf as well as of the external forces which may act on the door leaf. The drive may be used as well for holding the door leaf in the first position and/or second position. A drawback is that the drive is acting on the door leaf in its first position and/or second position, which preferably corresponds to a closed and/or maximum open up state of the swing door, with a much higher driving force and/or torque than necessary. The necessary driving force and/or torque for a stationary door leaf may be less than for moving the door leaf. The operation of the drive in the doors stationary first position and/or stationary second position may lead to undesired energy consumption, thermal load, overheating and/or a reduced lifetime.

It is a principal object of the present invention to enhance a method, a device and a swing door as mentioned in the preceding introduction such that the operation is realisable in a more effective and/or efficient way. Preferably it is an object of the present invention to avoid overheating and/or undesired wear or damage to the drive and/or to expand the lifetime of the drive.

The object of the invention is accomplished by a method according to the preceding introduction, wherein in the drive adds an additional driving force and/or torque to the door leaf in the first position and/or the second position of the door leaf in relation to an external driving force and/or torque acting on the door leaf to hold the door leaf in the first position or second position, respectively. In the device according to the invention a control unit may be provided for adding an additional driving force and/or torque by the drive to the door leaf in the first position and/or the second position of the door leaf in relation to an external driving force and/or torque acting on the door leaf to hold the door leaf in the first position or second position, respectively.

When the door leaf is in the first or second position, the intention is that the door leaf should be held still in that position. However, due to external forces such as wind, pressure applied by a person or a pressure difference on different sides of the door leaf, the door leaf will move slightly and thus deviating slightly from the first and the second position before the system can compensate for the external force. The first position and the second position are therefore considered to be the first position and the second position and positions to where the door leaf moves due to an external force before the additional driving force is applied to compensate for the external force. The first position and the second position are thus the first position and the second position and positions close to the first position and the second position. The first position and the second position thus includes an interval of positions around the intended first position and the second position, respectively.

The external driving force and/or torque is for example measured by sensing the torque acting on the door leaf, by determining the movement, i.e. the change in position, of the door leaf due to the external force, or the speed of the door leaf when moved due to the external force. When the external driving force and/or torque is determined the additional force and/or torque is added to compensate for the external driving force and/or torque.

It should be noted that the additional driving force and/or torque can be a negative driving force and/or torque. If for example, the door leaf in in the second position, which is in this example an open position, and wind blows on the door such that the wind assists in holding the door leaf in the open position, the additional driving force and/or torque is a negative force and/or torque such that the energy consumption of the drive which moves the door leaf is minimized. Another example is when the drive holds the door leaf in the first position, in this example a closed position, if the pressure difference on different sides of the door is such that the door could be held close mostly by the pressure difference, the additional driving force and/or torque is a negative driving force and/or torque. In these examples, if the wind instead would have been such that it worked to close the door leaf or the pressure would instead be such that the door leaf is pushed towards an open position, the additional driving force and/or torque is positive.

According to some aspects, the drive adds the additional driving force and/or torque to the door leaf also in relation to a further driving force and/or a torque of a further drive acting on the door leaf. The further drive is for example a spring element and/or a spring drive. Thus, the drive adds the additional driving force in relation to the further driving force of the spring element and/or the spring drive. The control unit is provided also for adding the additional driving force in relation to a further driving force and/or a torque of a further drive acting on the door leaf.

Thus, according to some aspects, the amount of the additional driving force and/or torque is adjusted in relation to the external driving force and/or torque and in case of a further driving force and/or torque also in relation to the further driving force and/or torque.

The amount of the additional driving force and/or torque may be adjusted based on a desired force, torque and/or position in relation to an actual force, torque and/or position of the door leaf. The actual force, torque and/or position represents, or in other words reflects, the external driving force and/or torque and in case of a further driving force and/or torque also the further driving force and/or torque. Preferably the actual force and/or torque includes the external driving force and/or torque and in case of a further driving force and/or torque also the further driving force and/or torque. According to some aspects, the control unit is adapted to adjust the amount of the additional driving force and/or torque according to above.

According to some aspects, the amount of the additional driving force and/or torque is adjusted in relation to the difference between the desired force, torque and/or position and the actual force, torque and/or position such that the desired force, torque and/or position is obtained. In other words, the difference between the desired force, torque and/or position and the actual force, torque and/or position is the additional force, torque and/or position that is needed to achieve the desired force, torque and/or position. The total force, torque and/or position is then the desired force, torque and/or position after addition of the additional force, torque and/or position. Thus, a total force, torque and/or position is the additional force, torque and/or position and the initial actual force, torque and/or position. Another term for desired force, torque and/or position is desired resulting force, torque and/or position.

The desired force and/or torque is for example dependent on the position of the door leaf. This is beneficial for example if the actual position deviates a lot from the desired position. The desired force and/or torque may then be higher than if the deviation is small so as to facilitate a faster move of the door leaf to the desired position.

The position of the door leaf is for example measured by measuring the angle of the door leaf compared to a door frame. Thus the first position, when being a closed position, has an angle of 0° and the second position, if corresponding to an open state of the door leaf, e.g. being a fully open position, may have an angle of about 80-150°, preferably the angle exceeds 90°, and in most applications is an angle of 120° sufficient.

According to some aspects, the control unit, at least one sensor and/or an encoder is designed for determining that the door leaf is in its first position and/or second position, preferably the control unit, the sensor and/or encoder is provided for measuring parameters related to the position of the door leaf.

The first position of the door leaf corresponds to, according to some aspects, a closed state of the door leaf and in the first position of the door leaf an additional driving torque is added and the amount of the additional driving torque is adjusted by the difference between the desired torque and the actual torque. The difference between the desired torque and the actual torque thus corresponds to the additional driving torque that should be added to reach the desired torque.

The second position of the door leaf corresponds to, according to some aspects, an open state of the door leaf and in the second position of the door leaf an additional driving torque is added and the amount of the additional driving torque is adjusted in relation to the difference between the desired position and the actual position such that the door leaf is moved from the actual position to the desired position. The desired position and the actual position may both be comprised in the term "second position". As previously described, the first and the second position will vary slightly due to the external force and/or torque. Thus the desired position is the intended precise second position and the actual position is the actual second position, both positions being, in this example, in the open state of the door leaf.

As previously described, the external driving force and/or torque is for example a force and/or torque caused by wind and/or wherein the external driving force and/or torque acting on the door leaf in a first position corresponding to a closed state of the door leaf is for example a force and/or torque caused by a pressure difference between the sides of the door leaf.

As an advantageous result, the driving force and/or torque of the drive can be adjusted in dependence of the position. According to some aspects, the driving force and/or torque of the drive is also adjusted in dependence of the movement of the door leaf. Preferably the driving force and/or torque of the drive is reduced in the first position and/or second position of the door leaf in comparison with the driving force and/or the torque of the drive during the movement of the door leaf. The drive may be active and/or in operation during movement of the door leaf as well as in the first position and/or second position of the door leaf. This may lead to a reduction of energy consumption, heat dissipation and/or thermal load. The risk of overheating and/or undesired wear or damage can be reduced. The lifetime of the drive may be extended. Preferably the driving force and/or torque is reduced when the door leaf and/or the swing door is in its closed position. When the door leaf has reached the closed position the driving force and/or torque can be adjusted to a lower level and still hold the door closed in a reliable way. Especially preferred, the lower level of the driving force and/or torque may be adjustable. Thus, the driving force and/or torque applied to the door leaf may be increased by the drive during the movement of the door leaf in comparison of an automated opening and/or closing of the door leaf without the additional driving force and/or torque.

According to a further embodiment of the method the level, value and/or amount of the additional driving force and/or torque of the drive applied to the door leaf is adjusted by a control unit and a drive. The control unit may comprise a micro-controller. Preferably the control unit is connected with the drive and/or additional sensors and/or encoders to determine and/or to monitor the position of the door leaf. The drive may be an electro-mechanical motor, preferably a DC-motor and more preferably a permanent magnet brushed DC-motor. The value, level and/or amount of the increased and/or additional driving force and/or torque may be adjusted by the control unit. The control unit may be connected to an input unit. The input unit may be designed to manually set and/or adjust the value, level and/or amount of the increased and/or additional driving force and/or torque by an operator. The increase and/or the decrease of the driving force and/or the torque in regard to an unchanged and/or normal value, level and/or amount of the driving force and/or torque may be adjustable. Especially preferred, the level and/or amount of the increased and/or additional driving force and/or torque is adjusted within a range of 0% to 99% of the maximum driving force and/or torque of the drive.

According to some aspects, the actual force, torque and/or position is obtained from the motor operation and/or measured by one or more sensors. Preferably the actual force, torque and/or position is obtained from the present and/or previous motor operation and/or measured by one or more sensors. For example can the actual torque be obtained from the present torque of the motor or the present current of the motor, since the torque is directly proportional to the current of for example a permanent magnet brushed DC motor. The actual position can for example be obtained by calculating the position of the door leaf based on the number and direction of rotations of the motor. Alternatively, the actual position can be measured by one or more sensors, such as one or more position sensors.

The value, level and/or amount of the driving force and/or torque of the drive acting on the door leaf can be higher during the movement of the door leaf than in the first position and/or second position of the door leaf. This may lead to a more efficient operation of the swing door. According to some aspects, the additional driving force and/or torque is applied to the door leaf by the drive during the movement of the door leaf from the first position of the door leaf to the second position of the door leaf and/or during the movement of the door leaf from the second position of the door leaf to the first position of the door leaf. The drive is for example used as a first drive for opening the door leaf from the first closed position of the door leaf to the second opened position of the door leaf. The door leaf may be moved from the second position to the first position by a further drive, preferably a spring element and/or a spring drive. A driving force and/or torque of the further drive acting on the door leaf may be increased by applying the additional driving force and/or torque by the first drive.

According to a further embodiment the driving force and/or torque of the drive is set to a lower value and/or level when the door leaf is in its first position and/or second position in relation to the value and/or level of the driving force and/or torque during the movement of the door leaf. The lower value and/or level of the driving force and/or torque may be greater than zero. Preferably the driving force and/or the torque of the drive is set to zero when the door leaf is in its first position and/or second position and there is no external driving force and/or torque acting on the door leaf. The drive may then be deactivated when the door leaf is in its first position and/or second position. More preferably the drive may in that case be deactivated by a control unit when the door leaf is in its first position and/or second position.

The driving force and/or torque of the drive may be decreased and/or set to zero when a position sensor is activated and/or when a preset time period is expired after the door leaf reached its first position and/or second position. The position sensor may determine if the door leaf is in its first position and/or second position or if it is deviating slightly. Preferably the time period is in the range of 0 seconds to 120 seconds, more preferably the time period is set to five seconds. Thus, the driving force and/or torque of the drive will be lowered after the expiry of the reset time period.

Preferably the door leaf is locked and/or fixed in its first position and/or second position by a locking device. The locking device may be controlled by a control unit. Thus, the door leaf can be reliably held in the first position and/or second position of the door leaf. Preferably a first locking device is provided for holding the door leaf in the first position and a second locking device is provided for holding the door leaf in the second position.

According to a further embodiment the first position of the door leaf corresponds to a closed state of the swing door and/or the door leaf. The second position of the door leaf may correspond to an open state of the swing door and/or door leaf. Preferably the drive moves the door leaf from the first position to the second position. Thus, it may be a main function of the drive to move the from the first position to the second position. In case of a further drive, the further drive may move the door leaf from the second position to the first position. The further drive may be a mechanical drive and/or a spring drive. In the further drive, an energy storage and/or a spring element may be charged by the movement of the door leaf from the first position to the second position. Especially preferred the door leaf is moved by the further drive, the energy storage and/or spring from the second position to the first position. Thus, the energy stored within the further drive, energy storage and/or the spring element may be used to close the swing door. Preferably the movement caused by the further drive, energy storage and/or spring element is realized in combination with the drive which adds an additional driving force and/or torque. Thus, the total driving force and/or torque to move the door leaf from the second position to the first position may be increased in relation to the driving force and/or torque applied only by the further drive, energy storage and/or spring element.

The first position and/or the second position of the door leaf may be adjustable and/or can be preset. Preferably the first position and/or the second position of the door leaf is automatically determinable by a control unit. Thus, there may be no need for manually determine and/or setting the first position and/or second position. More preferably the first position of the door leaf is recalibrated and/or reset to the actual position of the door leaf when the door leaf is not in its preset first position and, preferably at the same time, a locking device is activated to lock the door leaf and/or the swing door in its closed state. The activation of the locking device may be monitored by the control unit and/or a sensor. When the locking device is activated and the door leaf cannot be moved towards the second position and/or towards the open state of the swing door, the first position of the door leaf is recalibrated and/or reset to the actual position of the door leaf. The first position and/or the second position of the door leaf may be saved by a memory assigned to the control unit.

The second position of the door leaf may correspond to an open state of the swing door and/or the door leaf. Preferably the second position and/or the open state of the swing door correspond to a most opened position of the door leaf. The second position can be determined by moving the door leaf in a direction to open the swing door until the door leaf is stopped. The door leaf may be stopped by an obstacle in the path of the door leaf and/or by a doorstop. Preferably the position of the stopped door is set and/or saved as the second position of the door leaf. More preferably the first position is calculated by a control unit from the set second position of the door leaf.

According to the device of the invention a control unit may be provided for applying an increased driving force and/or torque to the door leaf during movement of the door leaf by the drive in comparison with the driving force and/or torque without the additional driving force and/or torque. The control unit, at least one sensor and/or an encoder may be designed for determining that the is in its first position and/or second position. The control unit, the at least one sensor and/or the encoder may be connected with each other. Preferably the control unit, the at least one sensor and/or the encoder is provided for measuring parameters related to the position of the door leaf. Such a parameter may be the opening angle of the door leaf, the door inertia, the load of the drive, the further drive, an energy storage and/or the tension of a spring element. The control unit, the at least one sensor and/or encoder may be mounted on the door leaf and/or on a door frame for the door leaf.

A locking device may be provided for locking the door leaf in its first position and/or second position. Preferably the locking device has a latching element for holding the door leaf in its first position and/or second position. The latching element may be designed as a mechanical and/or electromechanical latch. The locking device and/or the latching element may be connected with a control unit. The control unit may monitor the status of the locking device and/or the latching element, preferably the control unit monitors if the locking device and/or the latching element is activated and/or deactivated. The activation and/or deactivation of the locking element and/or the latching element may be controlled by the control unit.

According to a further embodiment a further drive, preferably an energy storage and/or a spring element, is provided for moving the door leaf. Preferably the further drive, energy storage and/or spring element is designed for closing the door leaf and/or swing door. The drive may interact with the further drive, energy storage and/or the spring element for moving the door leaf. The driving force and/or torque of the further drive, energy storage and/or spring element acting on the door leaf is for example increased by adding additional driving force and/or torque by the drive. Thus, the drive is used to add additional and/or extended driving force and/or torque to the door leaf for ensuring a reliable movement of the door leaf. The drive may supplement the driving force and/or torque of the further drive, energy storage and/or spring element.

The drive may be used as a holding device for holding the door leaf in its first position and/or second position. Preferably the value, level and/or amount of the driving force and/or torque acting on the door leaf by the drive is lower in the first position and/or second position of the door leaf than during movement of the door leaf. Thus, the driving force and/or torque acting on the door leaf may be higher during movement than in the first position and/or second position of the door leaf. In the first position and/or second position of the door leaf a much lower driving force and/or torque may be necessary to hold the door leaf than during movement of the door leaf.

A swing door having at least one door leaf and a drive for moving the door leaf is advantageous if a method of operation according to this invention and/or a device according to this invention is applied. A swing door may have a single door leaf or a double leaf. In case of a double leaf and/or two door leafs each door leaf may have a device according to this invention The following detailed description, given by way of example and not intended to limit the present invention solely thereto, will best be appreciated in conjunction with the accompanying figures, wherein like reference numerals denote like elements and parts, in which:

Figure 3A:
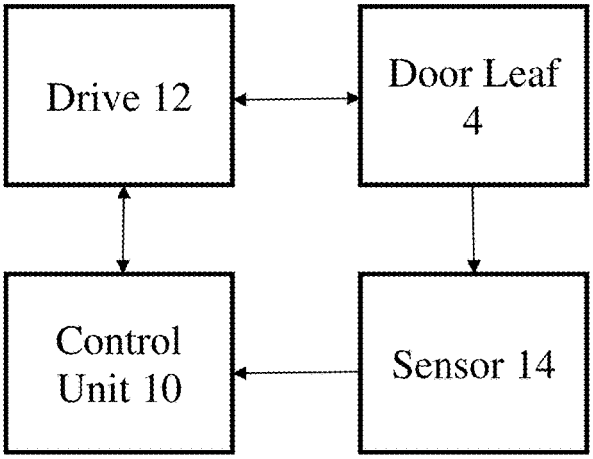

FIG. 3*a* is a schematic diagram showing components of a swing door according to embodiments of the present invention.

Figure 3B:
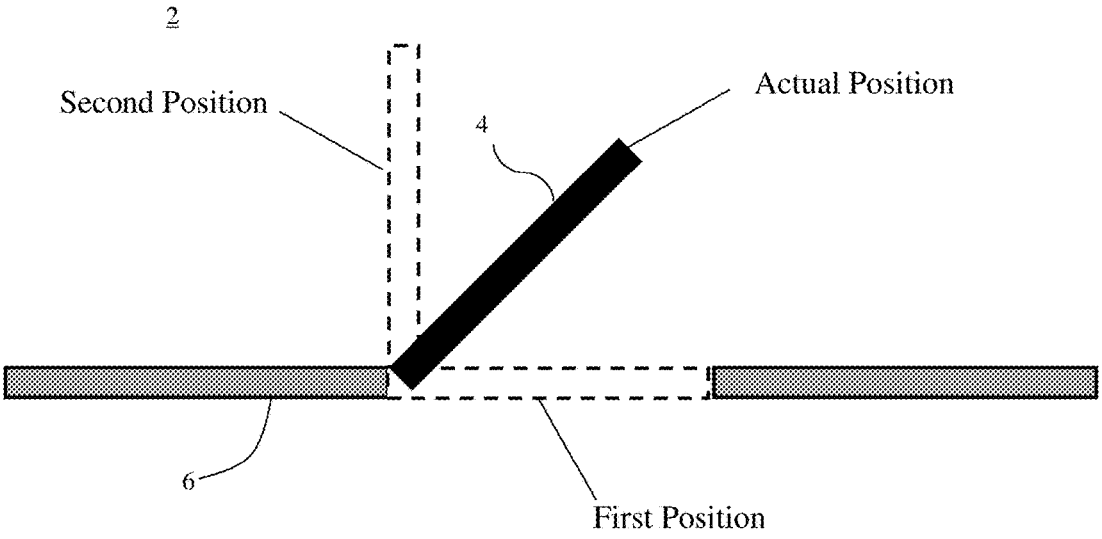

FIG. 3*b* is a top view of a swing door according to embodiments of the present invention.

The present invention will now be described more fully hereinafter with reference to the accompanying figures in which preferred embodiments of the invention are shown. This invention may, however, be embodied in many different forms and should not be construed as limited to the illustrated embodiments set forth herein. Rather, these illustrated embodiments are provided so that this disclosure will be thorough and complete, and will fully convey the scope of the invention to those skilled in the art.

Figure 1:
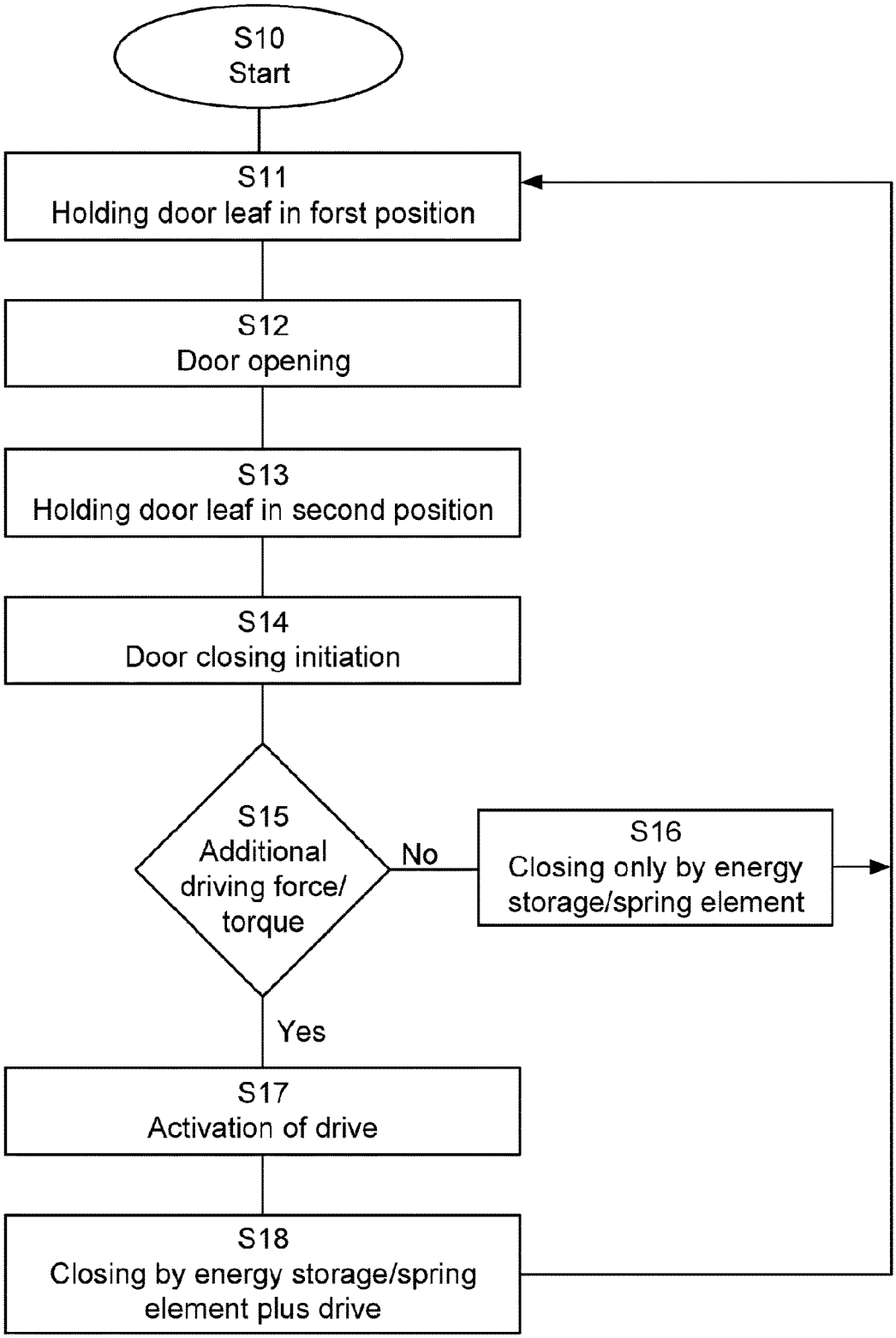
FIG. 1 is a schematic diagram of a method according to some aspects of the present invention.

FIG. 1 shows a schematic diagram of a method for operating a swing door 2 according to some aspects of the invention. FIG. 3*a* shows elements of a control system for the swing door and FIG. 3*b* shows a top view of the swing door 2 according to an embodiment of the disclosure. A drive 12 is provided for moving a door leaf 4 from a first position of the door leaf to a second position of the door leaf 4.

The operation method starts in step S 10. According to step S 11 the door leaf 4 of the swing door 2 is held in the first position. In this embodiment the first position of the door leaf 4 means that the swing door 2 is closed and the door leaf 4 is in its closed position. The door leaf 4 is held in the first position by the drive 12, which is activated to apply a driving force and/or a torque to the door leaf 4 to hold the door leaf 4.

In addition to this a locking device and/or a magnetic holder may be used to hold the door leaf 4 in its first position.

In a next step S 12 the door leaf is opened. Connected with drive 12 is controller 10. According to this embodiment the door leaf 4 is opened by the drive 12. The driving force and/or torque of the drive 12 acting on the door leaf 4 to open up the swing door 2 is higher than for holding the door leaf 4 in its first position according to step S 11. The value or amount of the driving force and/or torque of the drive 12 is controlled by a control unit 10. The door opening may be initialized by a motion sensor 4-6 and/or by manually pulling or pushing the door leaf 4 out of the first position towards the second position. During the opening movement an energy storage of a further drive is charged. In this embodiment the further drive a spring drive and a spring element is tensioned by the movement of the door leaf 4 from the first position to the second position.

When the door leaf 4 reaches its second position the door leaf 4 is held in the second position according to step S 13. In this embodiment the second position of the door leaf 4 corresponds to a preset most opened up position of the door leaf 4 to open the swing door 2. The door leaf 4 is held in the second position by the drive 12, which is activated to apply a driving force and/or a torque to the door leaf 4 to hold the door leaf 4. The driving force and/or torque of the drive 12 acting on the door leaf 4 to hold the door leaf 4 in its second position is according to some aspects lower than for moving the door leaf and may be equal to the driving force and/or torque in the first position according. In addition to this a locking device and/or a magnetic holder 20, 22 may be used to hold the door leaf in its second position. Alternatively, the drive 12 may be deactivated in the first and/or second position of the door leaf 4 and the door leaf 4 may be held in the first and/or second position by the locking device.

Figure 2:
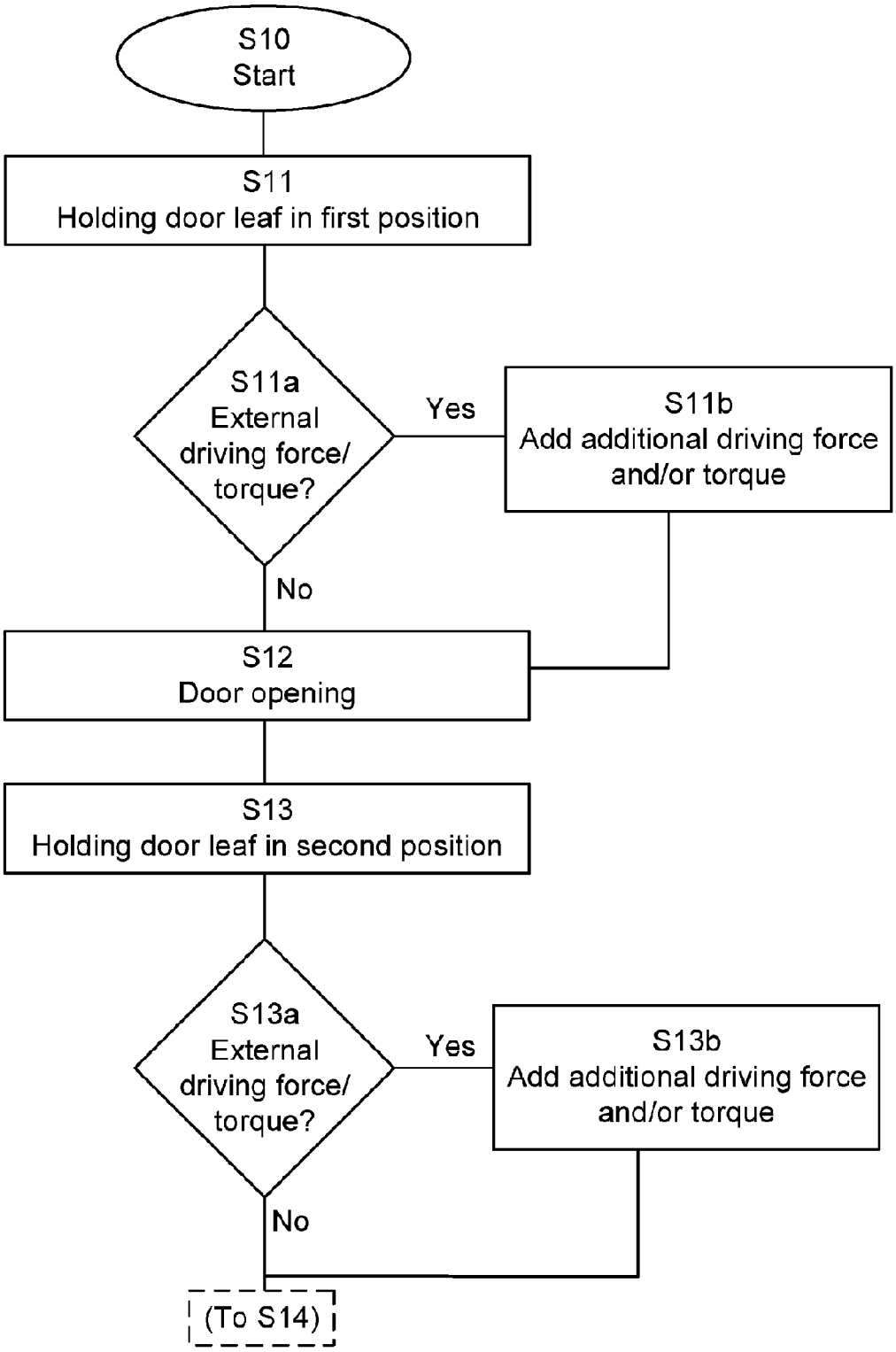
FIG. 2 is a schematic diagram of part of a method according to some aspects of the present invention.

FIG. 2 shows a schematic diagram of a part of a method for operating a swing door 2 according to some aspects of the invention. FIG. 2 illustrates the first 4 steps of the method, S10 to S13, of FIG. 1 in more detail. The steps are the same as the first four of FIG. 1 besides the clarifying examples of how to control the swing door 2 in the first and/or the second position.

In the steps of S11 and S13, the drive 12 adds S11*b*, S13*b* an additional driving force and/or torque to the door leaf 4 in the first position and/or the second position of the door leaf 4 in relation to an external driving force $T_{ext}$ and/or torque S11*a*, S13*a* acting on the door leaf to hold the door leaf 4 in the first position or second position, respectively. In the device according to the invention a control unit 10 may be provided for adding an additional driving force and/or torque by the drive 12 to the door leaf 4 in the first position and/or the second position of the door leaf in relation to an external driving force and/or torque $T_{ext}$ acting on the door leaf 4 to hold the door leaf 4 in the first position or second position, respectively.

When the door leaf 4 is in the first or second position, the intention is that the door leaf 4 should be held still in that position. However, due to external forces $T_{ext}$ such as wind, pressure applied by a person or a pressure difference on different sides of the door leaf 4, the door leaf 4 will move slightly and thus deviating slightly from the first and the second position before the system can compensate for the external force $T_{ext}$. The first position and the second position are therefore considered to be the first position and the second position and positions to where the door leaf 4 moves due to an external force $T_{ext}$ before the additional driving force is applied to compensate for the external force. The first position and the second position are thus the first position and the second position and position close to the first position and the second position.

The external driving force and/or torque $T_{ext}$ is for example measured by sensing the torque acting on the door leaf 4, by determining the movement, i.e. the change in position, of the door leaf due to the external force $T_{ext}$, or the speed of the door leaf 4 when moved due to the external force $T_{ext}$. When the external driving force and/or torque $T_{ext}$ is determined the additional force and/or torque is added to compensate for the external driving force and/or torque.

It should be noted that the additional driving force and/or torque can be a negative driving force and/or torque. If for example, the door leaf 4 in in the second position, which is in this example an open position, and wind blows on the door such that the wind assists in holding the door leaf 4 in the open position, the additional driving force and/or torque is a negative force and/or torque such that the energy consumption of the drive 12 which moves the door leaf 4 is minimized. Another example is when the drive 12 holds the door leaf 4 in the first position, in this example a closed position, if the pressure difference on different sides of the door is such that the door could be held close mostly by the pressure difference, the additional driving force and/or torque is a negative driving force and/or torque. In these examples, if the wind instead would have been such that it worked to close the door leaf 4 or the pressure would instead be such that the door leaf 4 is pushed towards an open position, the additional driving force and/or torque is positive.

According to some aspects, the drive 12 adds the additional driving force and/or torque to the door leaf 4 also in relation to a further driving force and/or a torque of a further drive g acting on the door leaf 4. The further drive is for example a spring element and/or a spring drive. Thus, the drive 12 adds the additional driving force in relation to the further driving force of the spring element and/or the spring drive. The control unit 10 is provided also for adding the additional driving force in relation to a further driving force and/or a torque of a further drive acting on the door leaf 4.

Thus, according to some aspects, the amount of the additional driving force and/or torque is adjusted in relation to the external driving force and/or torque $T_{ext}$ and in case of a further driving force and/or torque also in relation to the further driving force and/or torque.

The amount of the additional driving force and/or torque may be adjusted based on a desired force, torque and/or position in relation to an actual force, torque and/or position of the door leaf 4. The actual force, torque and/or position represents, or in other words reflects, the external driving force and/or torque $T_{ext}$ and in case of a further driving force and/or torque also the further driving force and/or torque. Preferably the actual force and/or torque includes the external driving force and/or torque $T_{ext}$ and in case of a further driving force and/or torque also the further driving force and/or torque.

According to some aspects, the control unit 10 is adapted to adjust the amount of the additional driving force and/or torque according to above. The actual force, torque and/or position is the force and/or torque that actually acts on the door leaf 4, i.e. the sum of all forces and/or torques acting on the door leaf 4 before adjusting the additional force and/or torque. The actual position is the position in which the door leaf 4 actually is arranged, i.e. the position of the door leaf 4 before adding the additional force and/or torque.

According to some aspects, the amount of the additional driving force and/or torque is adjusted in relation to the difference between the desired force, torque and/or position and the actual force, torque and/or position such that the desired force, torque and/or position is obtained. In other words, the difference between the desired force, torque and/or position and the actual force, torque and/or position is the additional force, torque and/or position that is needed to achieve the desired force, torque and/or position. The total force, toque and/or position is then the desired force, torque and/or position after addition of the additional force, torque and/or position. Thus, a total force, torque and/or position is the additional force, torque and/or position and the initial actual force, torque and/or position. Another term for desired force, torque and/or position is desired resulting force, torque and/or position.

The desired force and/or torque is for example dependent on the position of the door leaf 4. This is beneficial for example if the actual position deviates a lot from the desired position. The desired force and/or torque may then be higher than if the deviation is small so as to facilitate a faster move of the door leaf 4 to the desired position.

The position of the door leaf 4 is for example measured by measuring the angle of the door leaf 4 compared to a door frame 6. Thus the first position, when being a closed position, has an angle of 0° and the second position, if corresponding to an open state of the door leaf, i.e. being a fully open position, may have an angle of about 80-150°, preferably the angle exceeds 90°, and in most applications is an angle of 120° sufficient.

According to some aspects, the control unit 10, at least one sensor and/or an encoder 14 is designed for determining that the door leaf is in its first position and/or second position, preferably the control unit 10, the sensor and/or encoder 14 is provided for measuring parameters related to the position of the door leaf 4.

The first position of the door leaf 4 corresponds to, according to some aspects, a closed state of the door leaf 4 and in the first position of the door leaf 4 an additional driving torque is added and the amount of the additional driving torque is adjusted by the difference between the desired torque and the actual torque. The difference between the desired torque and the actual torque thus corresponds to the additional driving torque that should be added to reach the desired torque.

The second position of the door leaf 4 corresponds to, according to some aspects, an open state of the door leaf 4 and in the second position of the door leaf 4 an additional driving torque is added and the amount of the additional driving torque is adjusted in relation to the difference between the desired position and the actual position such that the door leaf 4 is moved from the actual position to the desired position. The desired position and the actual position may both be comprised in the term "second position". As previously described, the first and the second position will vary slightly due to the external force and/or torque $T_{ext}$. Thus the desired position is the intended precise second position and the actual position is the actual second position, both positions being, in this example, in the open state of the door leaf 4.

As previously described, the external driving force and/or torque $T_{ext}$ is for example a force and/or torque caused by wind and/or wherein the external driving force and/or torque $T_{ext}$ acting on the door leaf in a first position corresponding to a closed state of the door leaf 4 is for example a force and/or torque caused by a pressure difference between the sides of the door leaf 4.

The drive 12 gives rise to a driving force and/or torque. The additional driving force and/or torque is added to the driving force such that an adjusted driving force is provided by the drive 12.

In some aspects, the drive 12 adds an additional driving force and/or torque to the door leaf 4 in the first position of the door leaf 4 in relation to an external driving force and/or torque $T_{ext}$ acting on the door leaf 4 to hold the door leaf 4 in the first position.

After expiration of a preset time period a closing of the door leaf 4 is initiated according to step S 14. According to step S 15 it is checked by a control unit 10 if an additional driving force and/or torque shall be applied for realizing the closing movement.

If no additional driving force and/or torque has to be applied, the door leaf 4 is closed according to step S 16 only by the force available by the further drive 18 and the charged energy storage, which is in this case a tensioned spring element 4-9. When the door leaf 4 reaches its first position the door leaf 4 is hold in the first position according to step S 11.

If an additional driving force and/or torque has to be applied, the drive 12 is activated by the control unit 10 as shown by step S 17 to add a preset additional driving force and/or torque to the door leaf 4 during the closing movement. Thus, the driving force and/or torque of the further drive is supplemented and extended by an additional driving force and/or torque by the drive 12 according to step S 18. A driving force and/or a torque is applied to the door leaf 4, whereby the driving force and/or torque is increased by the drive 12 during the movement of the door leaf 4. When the door leaf 4 reaches its first position the door leaf 4 is held in the first position according to step S 11.

Although preferred embodiments of the present invention and modifications thereof have been described in detail herein, it is to be understood that this invention is not limited to these precise embodiments and variations and may be effected by one skilled in the art without departing from the spirit and scope of the invention as defined by the appended claims.

The use of expressions like "particularly", "preferably", "more preferably" or "especially preferred" etc. is not intended to limit the invention. Features which are not specifically or explicitly described or claimed may be additionally included in the structure or method according to the present invention without deviating from its scope.

REFERENCE NUMERALS

S 10 Start
S 11 Holding door leaf in first position
S 12 Door opening
S 13 Holding door leaf in second position
S 14 Door closing initiation
S 15 Additional driving force/torque?
S 16 Closing by energy storage/spring element
S 17 Activation of drive
S 18 Closing by energy storage/spring element plus drive

The invention claimed is:

1. A method of operating a door leaf of a swing door, the swing door comprising a control unit, a sensor connected with the door leaf and the control unit, the sensor communicating a current position of the door leaf and an applied torque on the door leaf to the control unit, and a drive connected with the control unit and the door leaf, and wherein the control unit computes a drive torque and controls the drive unit to apply the drive torque to the door leaf based on the communication from the sensor, the method comprising the steps of:

(a) setting, by the control unit, the drive torque to a first torque and energizing the drive unit to apply the first torque to the door leaf, wherein the first torque moves the current position of the door leaf from a predetermined closed position to a predetermined open position;

(b) setting, by the control unit, the drive torque to a second torque and energizing the drive unit to apply the second torque, wherein the second torque maintains the door leaf in the open position;

(c) detecting, by the sensor, that the current position of the door leaf has moved away from the open position and that the door leaf is subject to the applied torqued by an external force;

(d) calculating, by the control unit based on the current position of the door leaf and the applied torque detected by the sensor, a third torque as a difference between the second torque and the applied torque; and (f) setting the drive torque to the third torque and energizing the drive unit to maintain the current position of door leaf in the open position while it is subject to the external force.

2. The method according to claim 1, wherein the open position is an angular position of the door leaf with respect to a door frame between about 80 degrees and 150 degrees.

3. The method according to claim 2, wherein the closed position is an angular position of the door leaf with respect to the door frame of about 0 degrees.

4. The method according to claim 1, wherein the external force results from wind or a pressure difference between the sides of the door leaf.

5. The method according to claim 1, wherein the drive is an electro-mechanical motor.

6. The method according to claim 1, wherein, when the door leaf is in the closed position, the control unit sets the drive torque to a closing torque and energizes the drive unit to maintain the door leaf in the closed position.

7. A swing door comprising:

a door leaf having a predetermined closed position and a predetermined open position;

a sensor connected with the door leaf, the sensor detecting a current position of the door leaf and an applied torque on the door leaf;

a control unit connected to the sensor, the control unit calculating a drive torque; and a drive connected to the control unit, wherein the control unit causes the drive to apply the drive torque to the door leaf, wherein the control unit sets the drive torque to a first torque to move the door leaf from the closed position to the open position, wherein the control unit sets the drive torque to a second torque to maintain the door leaf in the open position, wherein the sensor detects that the current position is different from the open position and that the door leaf is subject to the applied torque due to an external force, wherein the control unit calculates a third torque as a difference between the second torque and the applied torque and sets the drive torque to the third torque to maintain the current position of door leaf in the open position while it is subject to the external force.

8. The device according to claim 7, wherein the open position is an angular position of the door leaf with respect to a door frame between about 80 degrees to 150 degrees.

9. The device according to claim 8, wherein the closed position is an angular position of the door leaf with respect to the door frame of about 0 degrees.

10. A method for operating a swing door comprising a door panel, a control unit, a sensor connected with the control unit and the door panel, the sensor determining a current position of the door panel and an applied torque on the door panel, and an electro-mechanical drive connected with the control unit and the door panel, wherein the control unit computes a drive torque and controls the electro-mechanical drive to apply the drive torque to the door panel so as to move the door panel, the method comprising:

(a) setting, by the control unit, the drive torque to a first torque to energize the electro-mechanical drive to apply the first torque to the door panel, wherein the first torque moves the current position of the door panel from a predetermined closed position to a predetermined open position;

(b) setting the drive torque to a second torque and energizing the electro-mechanical drive, wherein the second torque maintains the door panel in the open position;

(c) detecting, by the sensor, that the current position of the door panel has moved away from the open position and that the door panel is subject to the applied torque due to an external force;

(d) calculating, by the control unit based on the current position of the door panel and the applied torque, a third torque as a difference between the second torque and the applied torque; and (f) setting the drive torque to the third torque to maintain the current position of door panel in the open position while it is subject to the external force.

11. The method of claim 10, wherein the open position is an angular position of the door leaf with respect to a door frame between about 80 degrees to 150 degrees.

12. The method of claim 11, wherein the closed position is an angular position of the door leaf with respect to the door frame of about 0 degrees.

13. The method of claim 10, wherein the drive is operable to apply a closing torque in the direction from the open position to the closed position, and wherein the method further comprises:

(g) determining that the panel is in the closed position; and fill applying the closing torque to maintain the panel in the closed position.

14. The method of claim 10, wherein the electromechanical drive comprises a permanent magnet brushed DC-motor.

* * * * *